US005552755A

United States Patent [19]

Fello et al.

[11] Patent Number: 5,552,755

[45] Date of Patent: Sep. 3, 1996

[54] CIRCUIT BREAKER WITH AUXILIARY SWITCH ACTUATED BY CASCADED ACTUATING MEMBERS

[75] Inventors: Joseph P. Fello, Penn Hills Township; Michael J. Whipple, New Sewickley, both of Pa.

[73] Assignee: Eaton Corporation, Cleveland, Ohio

[21] Appl. No.: 943,803

[22] Filed: Sep. 11, 1992

[51] Int. Cl.[6] ..... H01H 73/00

[52] U.S. Cl. ..... 335/18; 335/8; 361/42

[58] Field of Search ..... 335/8–10, 17, 335/6, 35, 18, 41, 132, 202; 361/42–50

[56] References Cited

U.S. PATENT DOCUMENTS

| | | | |
|---|---|---|---|
| 3,073,926 | 1/1963 | Ellsworth et al. | 335/35 |
| 3,566,318 | 12/1968 | Gelzheiser et al. . | |
| 4,081,852 | 3/1978 | Coley et al. . | |
| 4,209,761 | 6/1980 | Klein et al. | 335/17 |
| 4,641,127 | 2/1987 | Morris et al. | 361/45 |
| 4,641,216 | 2/1987 | Morris et al. . | |
| 4,641,217 | 2/1987 | Morris et al. . | |
| 4,768,025 | 8/1988 | Vila-Masot | 340/638 |
| 4,794,356 | 12/1988 | Yu et al. . | |
| 4,831,221 | 5/1989 | Yu et al. . | |
| 4,912,439 | 3/1990 | Nagy et al. . | |
| 4,939,490 | 7/1990 | Bernier et al. . | |
| 5,043,688 | 8/1991 | Castonguay et al. . | |

*Primary Examiner*—Lincoln Donovan
*Attorney, Agent, or Firm*—Martin J. Moran

[57] ABSTRACT

An auxiliary switch, mounted in a compartment in the molded housing of a circuit breaker separate from the compartment in which the circuit breaker mechanism is mounted, is actuated, when the circuit breaker contacts are open, by cascaded actuating members, one of which engages, through a housing panel dividing the compartments, the latchable cradle of the circuit breaker mechanism to actuate the auxiliary switch when the circuit breaker is tripped, and the second of which is spring biased against a cam surface on an operating member incorporating the circuit breaker handle to actuate the auxiliary switch when the handle is in the off position.

4 Claims, 6 Drawing Sheets

CIRCUIT BREAKER WITH AUXILIARY SWITCH ACTUATED BY CASCADED ACTUATING MEMBERS

CROSS REFERENCE TO RELATED APPLICATIONS

U.S. patent application Ser. No. 07/676,150, filed on Mar. 27, 1991 and entitled DUAL WOUND TRIP SOLENOID.

Commonly owned U.S. patent application entitled GROUND FAULT CIRCUIT BREAKER WITH FLAT BUS BARS FOR SENSING COILS concurrently filed in the names of Joseph Joseph P. Fello, William E Smith, Wilbert E Lindsay and Michael J. Whipple having Ser. No. 07/943,670 U.S. patent application entitled INSULATING BARRIERS FOR CIRCUIT BREAKER BUS BARS AND A GROUND FAULT CIRCUIT BREAKER INCORPORATING SAME concurrently filed in the names of Michael J. Whipple and Joseph P. Fello, having Ser. No. 07/943,796; and U.S. patent application entitled GROUND FAULT CIRCUIT BREAKER WITH TEST SPRING/CONTACTS DIRECTLY MOUNTED TO TEST CIRCUIT OF PRINTED CIRCUIT BOARD concurrently filed in the names of Joseph P. Fello, Michael J. Whipple, Umesh C. Patel and Garry B. Theadore, having Ser. No. 07/943,801.

BACKGROUND OF THE INVENTION

1. Field of the Invention

This invention relates to circuit breakers with auxiliary switches which provide an indication of the state of the circuit breaker contacts, and in particular to small circuit breakers for residential and light industrial and commercial use incorporating such an auxiliary switch.

2. Background Information

Large multi-pole circuit breakers typically have a cross bar which links the poles together and opens the contacts in all phases if any phase trips open. Often, an auxiliary switch is provided in such breakers to generate an external indication that the contacts are open such as for electrical interlocks between multiple circuit breakers or for remote monitorina of circuit breaker operation. Since the crossbar provides an indication of the state of the circuit breaker contacts, either opened or closed, the cross bar has been used to actuate the auxiliary switch.

In some circuit breakers an additional switch, called an alarm switch, is included which is actuated when the circuit breaker is tripped, again for remote monitoring of breaker operation.

The small circuit breakers used for residential and light commercial or industrial use have to date not been provided with an auxiliary switch. Adding an auxiliary switch to such small circuit breakers is made difficult by the fact that such breakers typically do not have a cross bar, and is further complicated by the limited space in such breakers which are configured to be mounted in a standardized load center or panel board. An instance is known of such a small breaker which is equipped with an alarm switch to provide a remote indication that the circuit breaker is tripped. The switch is mounted in a compartment adjacent the compartment containing the circuit breaker mechanism and has an extension on its plunger which extends through the housing wall and is engaged by the latchable cradle of the circuit breaker mechanism. Unlatching of the cradle to trip the breaker results in actuation of the alarm switch.

There remains a need for a small residential or light industrial or commercial circuit breaker which is provided with an auxiliary switch to generate an electrical indication that the circuit breaker contacts are open. This must be accomplished within a standardized size of such circuit breakers so that they may be continued to be used in the standard load centers and panel boards.

SUMMARY OF THE INVENTION

These and other needs are satisfied by the invention which is directed to a circuit breaker suitable for residential and light commercial or industrial use which incorporates an auxiliary switch and actuating means which is operated by the breaker mechanism of circuit breakers typically used for residential and light industrial or commercial use. More particularly, the invention is directed to a circuit breaker of the type which includes a movable contact arm carrying a movable contact at one end and engaged at the other end by a pivotally mounted operating member having an integral handle, a pivotally mounted latchable cradle, a spring connecting the cradle and the contact arm, and a trip device latching the cradle in a latched position and unlatching the cradle in response to an overload condition to trip the contact arm and open the contacts while moving the operating member to a tripped position. In such circuit breakers, the actuating means for the auxiliary switch includes a first actuating member engaging the cradle and actuating the auxiliary switch when the cradle is unlatched by tripping of the circuit breaker, and a second actuating member which is engaged by the operating member and which actuates the auxiliary switch when the handle which is an integral part of the operating member is in the off position. The two actuating members are cascaded to actuate the auxiliary switch whenever the contacts are open, both upon tripping of the circuit breaker and when the handle is moved to the off position.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

The invention will be shown as applied to a single pole residential or light commercial or industrial ground fault circuit breaker; however, it will be evident to those skilled in the art that the invention is also applicable to multi-pole circuit breakers as well.

Figure 1:
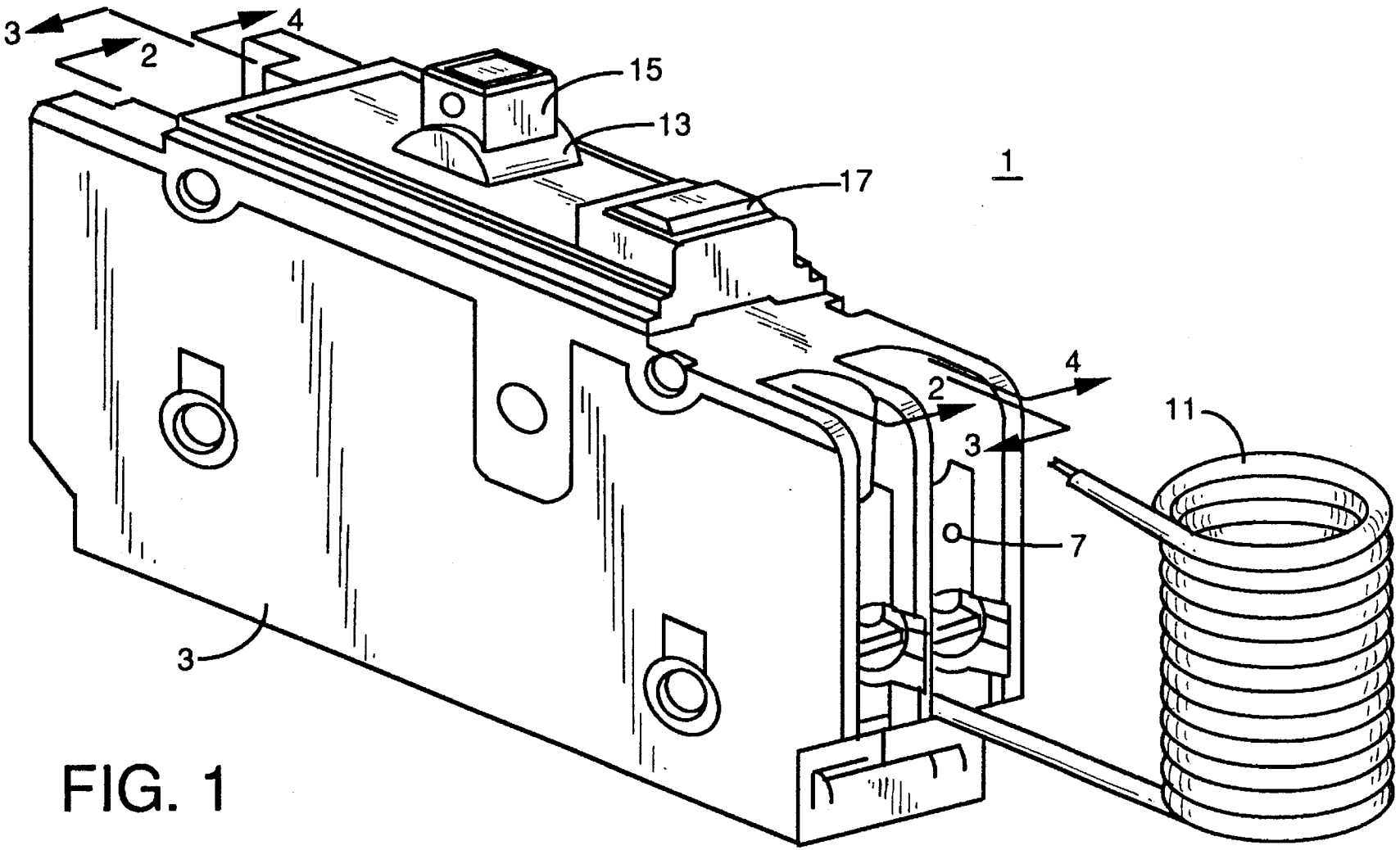
FIG. 1 is an isometric view of a ground fault circuit breaker to which the invention has been applied.

Referring to FIG. 1, the ground fault circuit breaker 1 comprises a housing 3 which is composed of electrically insulating material such a thermo-setting resin. A load terminal 5 and load neutral terminal 7 are provided for connecting the circuit breaker to a load. A line terminal 9 (see FIG. 2) is provided at the opposite end of the housing 3 for connection to a commercial power system. The line side of the neutral is connected to a pigtail 11. The ground fault circuit breaker 1 includes an operating member 13 having an integral molded handle 15 extending through the housing 3. A ground fault test switch 17 is also accessible through the housing.

Figure 2:
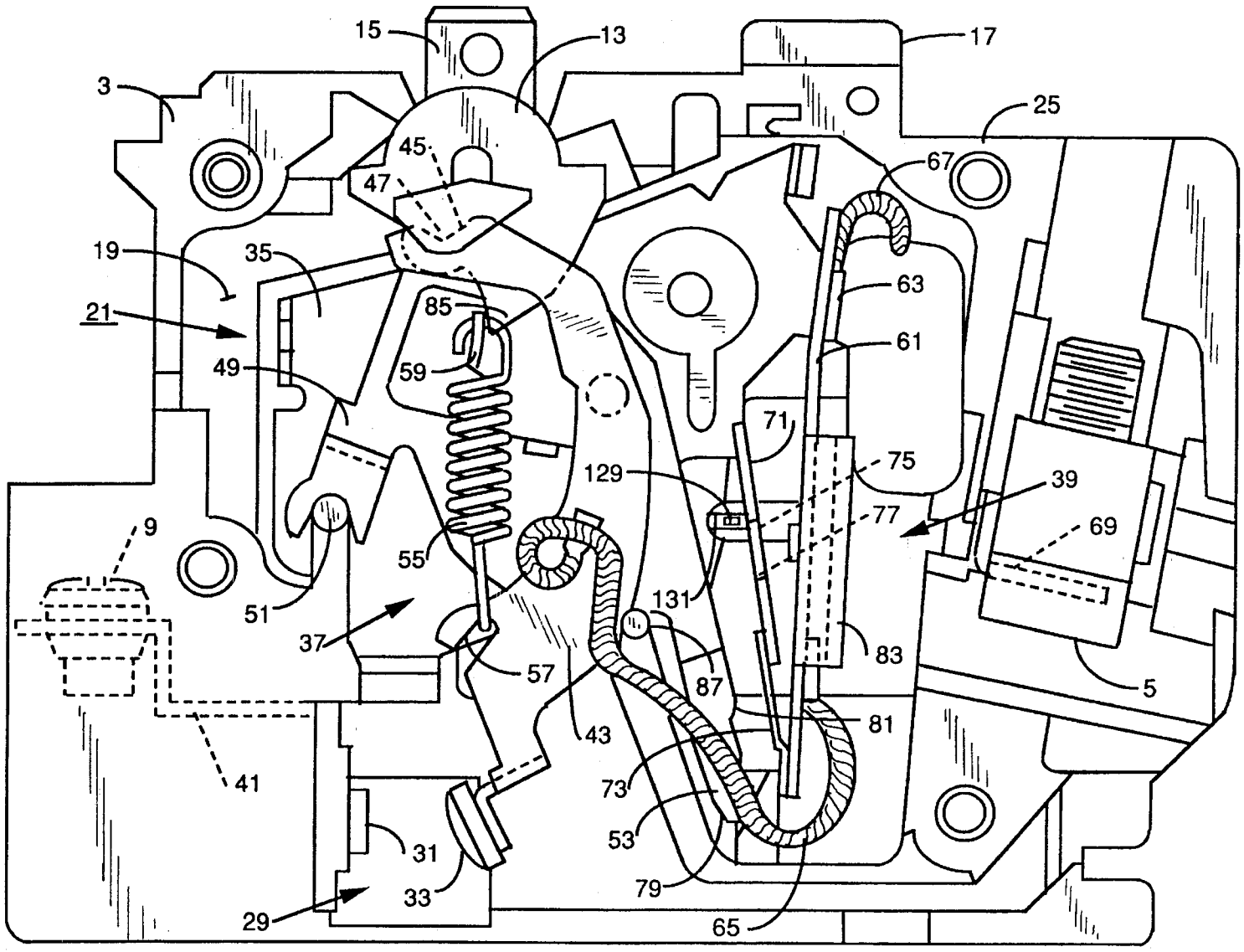
FIG. 2 is a vertical section taken along the line 2—2 through the circuit breaker of FIG. 1.
Figure 3:
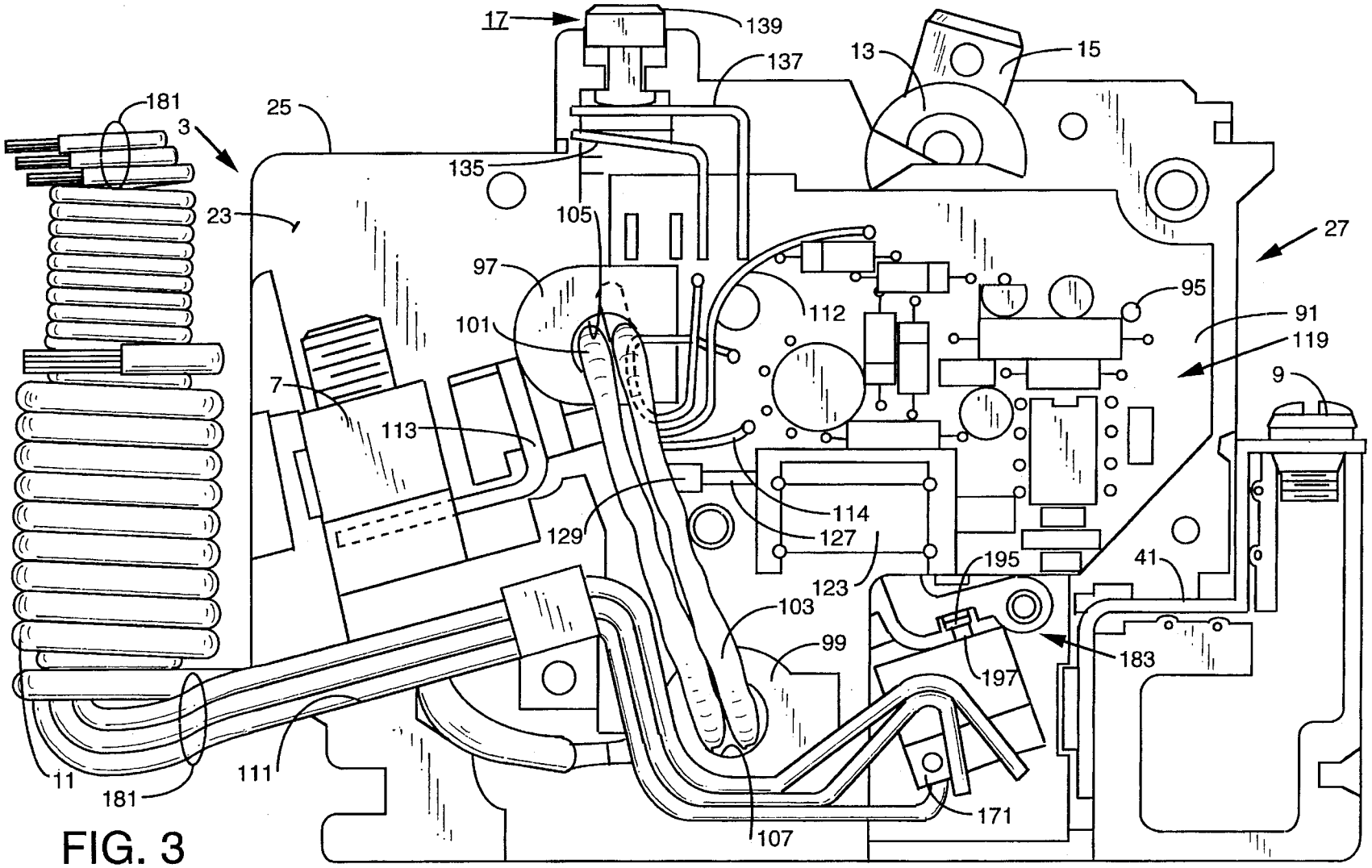
FIG. 3 is another vertical section through the circuit breaker of FIG. 1 taken along the line 3—3.

The housing 3 defines a compartment 19 (see FIG. 2) in which a circuit breaker mechanism 21 is housed, and a second compartment 23, separated from the compartment 19 by a center panel 25, which houses a ground fault circuit interrupter 27 (see FIG. 3).

The circuit breaker mechanism 21 is of the type disclosed in U.S. Pat. No. 3,566,318 which is hereby incorporated by reference for a complete description of the structure and its operation. Briefly, the circuit breaker mechanism 21 includes a pair of separable contacts 29, including a fixed contact 31 and a movable contact 33, a supporting metal frame 35, an operating mechanism 37, and a trip device 39. The fixed contact 31 is connected by a conductor 41 to the line terminal 9.

The operating mechanism 33 includes a flat electrically conductive generally C-shaped contact arm 43 to which the movable contact 33 is secured at the lower end. The upper end of the contact arm has a notch 45 which is biased against a projection 47 on the operating member 13 in a manner to be discussed. The operating member is mounted in the housing 3 for rotation about an axis perpendicular to the plane of FIG. 2. Motion is transmitted from the operating member 13 to the contact arm 43 when the circuit breaker 1 is manually operated, and from the contact arm 43 to the operating member 13 when the breaker is automatically tripped.

The operating mechanism 37 further includes a latchable cradle 49 whitish is pivotally supported at one end by a pivot 51 molded into the center panel 25. The other end 53 of the cradle 49 is latched by the trip device 39 in a manner to be discussed.

As more specifically described in U.S. Pat. No. 3,254,176, the ends of the latchable cradle 49 are offset and disposed along a plane which is parallel to a plane in which the main body portion of the latchable cradle 49 is disposed. This places the ends of the cradle 49 in the same plane as the C-shaped contact arm 43. A spring 55 is connected, under tension, at one end in a slot 57 near the lower end of the C-shaped contact arm 43, and at the other end to a bent over tab 59 projecting outward from the main body of the latchable cradle 49.

The trip device 39 includes a bimetal 61 secured at an upper end to a bent over tab 63 on the frame 35. The contact arm 43 of the operating mechanism 37 is connected to the lower end of the bimetal 61 by a flexible conductor 65. The upper end of the bimetal 61 is connected by another flexible conductor 67 to the ground fault detector discussed below which in turn is connected to a tang 69 extending through an opening in the end wall of the housing 3. The load terminal 5 is connected to the external end of the tang 69 for connection of the circuit breaker to a load. The closed circuit through the circuit breaker 1 extends from the line terminal 9, conductor 41, fixed contact 31, movable contact 33, contact arm 43, flexible conductor 65, bimetal 61, flexible conductor 67, the ground fault detector, tang 69, and load terminal 5.

The trip device 39 further includes an elongated, rigid magnetic armature or latch member 71 mounted on a spring 73 which is welded to the free lower end of the bimetal 61. The magnetic armature 71 extends generally upward along side the bimetal 61, and has an opening 75 forming a latch surface 77 at the base of the opening. The latch end 53 of the cradle 49 is formed with a latch surface 79 and a stop surface or fulcrum part 81. The armature 71 serves as a stop to engage the fulcrum part 81 of the latchable cradle 49 in the latched position of the cradle. A U-shaped magnetic member 83 is secured to the bimetal 61 adjacent the magnetic armature 71 to concentrate the flux created by current flowing through the bimetal.

The circuit breaker is shown in FIG. 2 in the tripped position. The cradle 49 is latched for resetting the circuit breaker by rotating the handle 15 clockwise, as shown in FIG. 2. This causes a projection 85 on the operating member 13 to engage the tab 59 and rotate the latchable cradle 49 in the counterclockwise direction until the latch end 53 is latched in the opening 75 in the magnetic armature 71. This operation is shown in detail in U.S. Pat. No. 3,566,318.

The separable contacts 29 are closed by moving the handle 15, with the cradle 49 latched, in the counterclockwise direction as viewed in FIG. 2 to the on position. This causes the projection 47 on the operating member 13 which engages the notch 45 in the contact arm 43 to move the upper end of the contact arm to the right of the line of action of the spring 55 resulting in closure of the contacts 29. The contacts 29 could be manually opened from this closed position by rotating the handle 15 clockwise, as viewed in FIG. 2, to the off position.

The trip device 39 provides over-current protection through the bimetal 61. Prolonged currents above the rated current of the circuit breaker heats the bimetal 61 causing the lower end to deflect to the right, as shown in FIG. 2, thereby unlatching the cradle 49, as the armature 71 pivots about the fulcrum 81 until the latch surface 79 on the latch end 53 of the cradle slides off of the latch surface 77. When unlatched, the cradle 49 is rotated clockwise by the spring 55 until it engages a stop pin 87 molded in the center panel 25 of the circuit breaker housing. During this movement, the line of action of the spring 55 moves to the right of the pivot formed by the notch 45 in the contact arm and the projection 47 on the operating member 13, whereupon the spring 55 biases the contact arm 43 in the opening direction to open the contacts 29 and moves the contact arm 43 so that the line of action of the force exerted by the spring on the operating member 13 shifts across the rotational axis of the operating member 13 and actuates the operating member to the tripped position shown in FIG. 2. The tripped position of the operating member 13 is intermediate the "on" and "off" positions. The operating member 13 is stopped in the intermediate or tripped position seen in FIG. 2 when the projection 85 engages the tab 59 on the cradle 49. The contact arm 43 is stopped in the open position seen in FIG. 2 when it engages the stop pin 87. The circuit breaker is reset following the trip in the manner discussed above.

The trip device 39 also provides short circuit protection. The very high current through the bimetal 61 produced by a short circuit induces a magnetic flux which is concentrated by the magnetic member 83 and of sufficient magnitude to attract the armature 71 to the magnetic member, thereby unlatching the cradle 49 to trip the circuit breaker.

As discussed, the circuit breaker 1 also provides ground fault protection, both for line to ground faults and neutral to ground faults. All the components for ground fault protection are mounted on a printed circuit board 91 in the compartment 23 formed in the molded housing 3 as shown in FIG. 3. The printed circuit board 91 is positioned within the compartment 23 by a pin 95 molded into the center panel 25. A suitable ground fault protection circuit is the well-known dormant oscillator-type such as disclosed in U.S. patent application Ser. No. 676,150 referred to above. This circuit includes two transformers formed by toroidal sensing coils 97 and 99. The primaries of the transformers are formed by a neutral lead 101 and a line lead 103 which pass through the central openings 105 and 107 in the sensing coils 97 and 99, respectively. The lower end of the neutral 101 is welded to the end of the pigtail 11 extending through an opening 111 in the housing 3 for connection to a panel neutral. The upper end of the neutral lead 101 is connected to the printed circuit board by a lead 112 and to a tang 113 leading to the load neutral terminal 7. The lower end of the line lead 103 is connected to the flexible conductor 67 leading from the bimetal 61 and by lead 114 to the printed circuit board, while the upper end is connected through an opening in the central panel 25 to the tang 69 leading to the load terminal 5.

In operation, upon detection of a grounded load neutral conductor through the toroids 97 and 99, the ground fault circuit energizes a trip solenoid 123. Energization of the trip solenoid 123 results in extension of the solenoid plunger 127. A flag 129 secured to the plunger 127 extends through a slot 131 in the center panel 25 and pushes the armature 71 to the right as viewed in FIG. 2 to trip the circuit breaker, thereby opening the separable contacts 29.

The ground fault function of the circuit breaker can be tested by the test switch 17. The test switch 17 includes a fixed contact 135, a movable contact 137 and a test button 139. The fixed contact 135 and the movable contact 137 each comprise an electrically conductive metallic strip, such as a copper strip, directly mounted on the printed circuit board 91. The resiliently deformable contact 137 also serves as a spring to bias the test button 139 outward to the unactuated position. When the ground fault detector is to be tested, the test button 139 is depressed thereby resiliently deforming the movable contact 137 to bring it into electrical contact with the fixed contact 135 to complete a test circuit which trips the circuit breaker.

Figure 5:
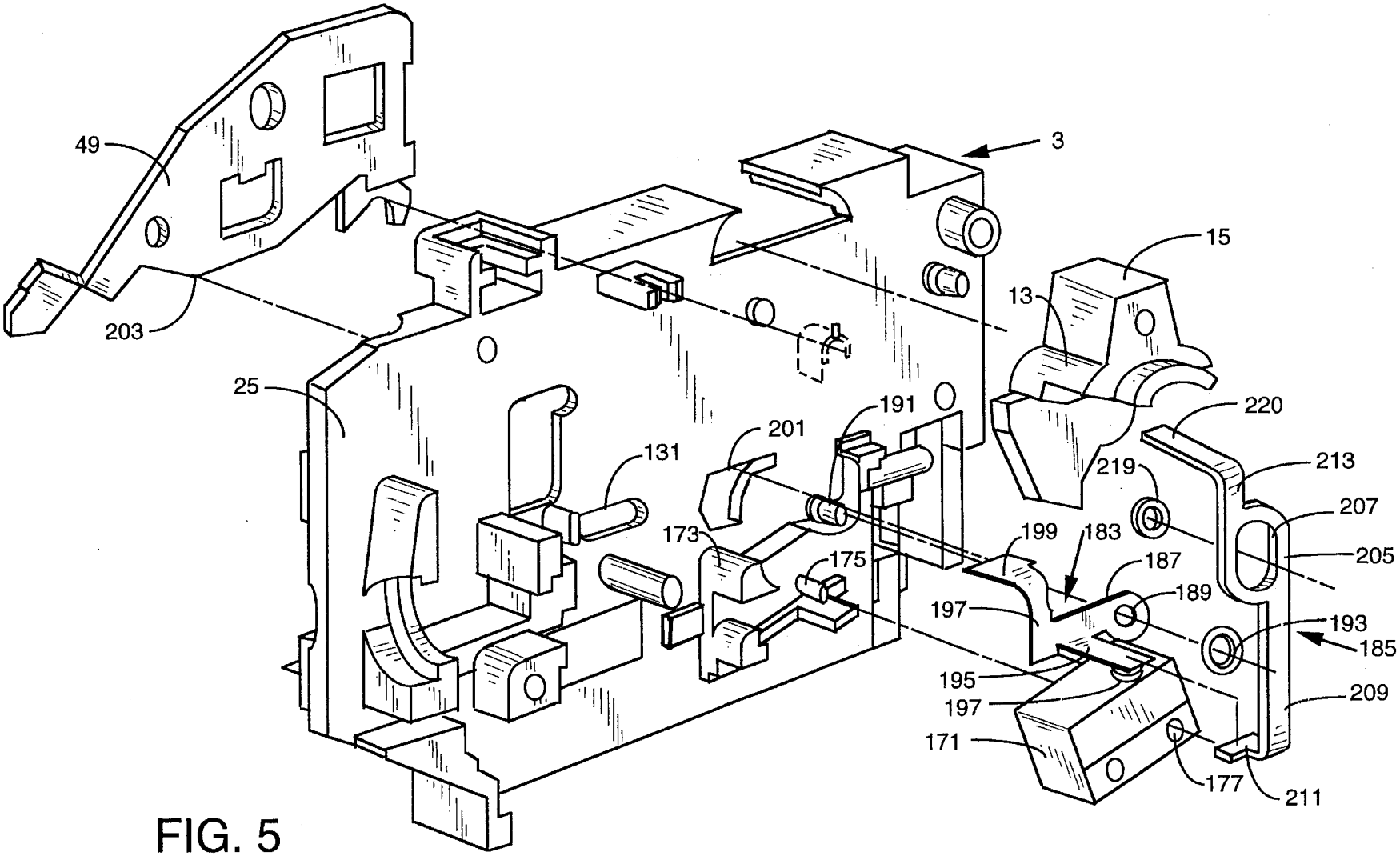
FIG. 5 is an exploded isometric view of selected parts of a circuit breaker shown in FIGS. 1 through 4.

The circuit breaker 1 incorporates a micro switch 171 mounted in the compartment 23 within the housing 3. The micro switch 171 is maintained in place within the compartment 23 by supports 173 molded into the center panel 25 of the housing and including a pin 175 which is received in a bore 177 in the switch 171 (see FIG. 5). The switch 171 is a conventional switch having both a normally open and a normally closed set of contacts actuated by a plunger 179. The two hot leads and a common lead (collectively) 181 are lead out of the housing 3 through the same opening 111 as the pigtail 11, as seen in FIG. 3.

The auxiliary switch 117 is actuated by two cascaded actuating members 183 and 185. The first actuating member 183, which is preferably stamped from sheet metal material, has a central enlarged portion 187 with an aperture 189 which is pivotally mounted on a molded pin 191 on the center panel 25, and is retained in place by a speed nut 193. A tab 195 bent to extend laterally from the central enlarged portion 187 forms one end of the first actuating member 183 which bears against the plunger 179 of the micro switch 171. A projection 197 extends upward from the center section 187, is bent into a horizontal plane and terminates in a tab 199 which forms a second end of the first actuating member 183. The tab 199 projects through an opening 201 in the center panel 25 of the housing 3 and projects below the lower edge 203 of the center portion of the cradle 49.

Figure 6:
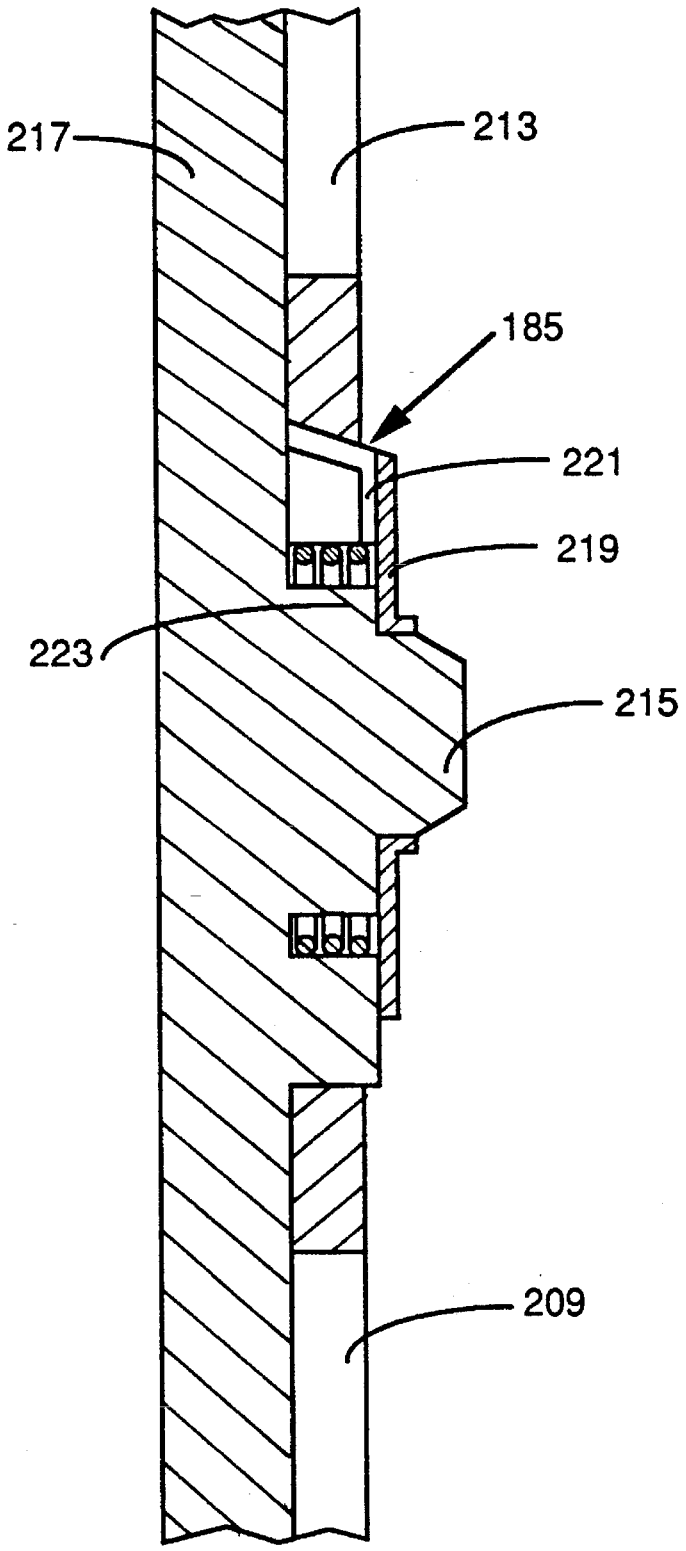
FIG. 6 is a fragmentary vertical section taken along the line 6—6 in FIG. 4.

The second actuating member 185 is also preferably stamped from sheet metal material and has a wide center portion 205 with an elongated opening 207 therein. A first extension 209 extends downward from one side of the center section 205, is bent laterally toward the free end and terminates in a tab 211 which forms a first end 220 of the second actuating member 185. A second projection 213 extends upward from the opposite side of the upper end of the center section 205 of the second actuating member 185 and is bent laterally near the free end to form a second end of the second actuating member 185. The second actuating member 185 is mounted for vertical, rectilinear movement on a pin 215 molded into a cover plate 217 of the housing 3 (see FIG. 4), which forms with the center panel 25, the compartment 23. The second actuating member 185 is retained in place by a speed nut 219 threaded onto the pin 215. A torsion spring 221 seated on a boss 223 (see FIG. 6) surrounding the pin 215, biases the second actuating member 185 in the upward direction. Projections 225 and 227 molded into the cover plate 217 form a channel for the downward projection 209 to guide the second actuating member 185 in its vertical, rectilinear movement.

The tab 211 on the first end of the second actuating member 185 bears against and operates the micro switch 171 through the tab 195 forming the first end of the first actuator 183, so that the first and second actuating members are cascaded for operation of the micro switch 171. The second end of the second actuating member 185 formed by the tab 220 on the upward projection 213 bears against a cam surface 229 on the underside of the operating member 13. This cam surface 229 is contoured so that with the handle 15 in the off position (as shown in phantom line in FIG. 4), the second actuating member 185 is deflected downward against the bias of the spring 221 to depress the plunger 179 of the micro switch 171 through the tab 195 on the first actuating member 183.

Figure 4:
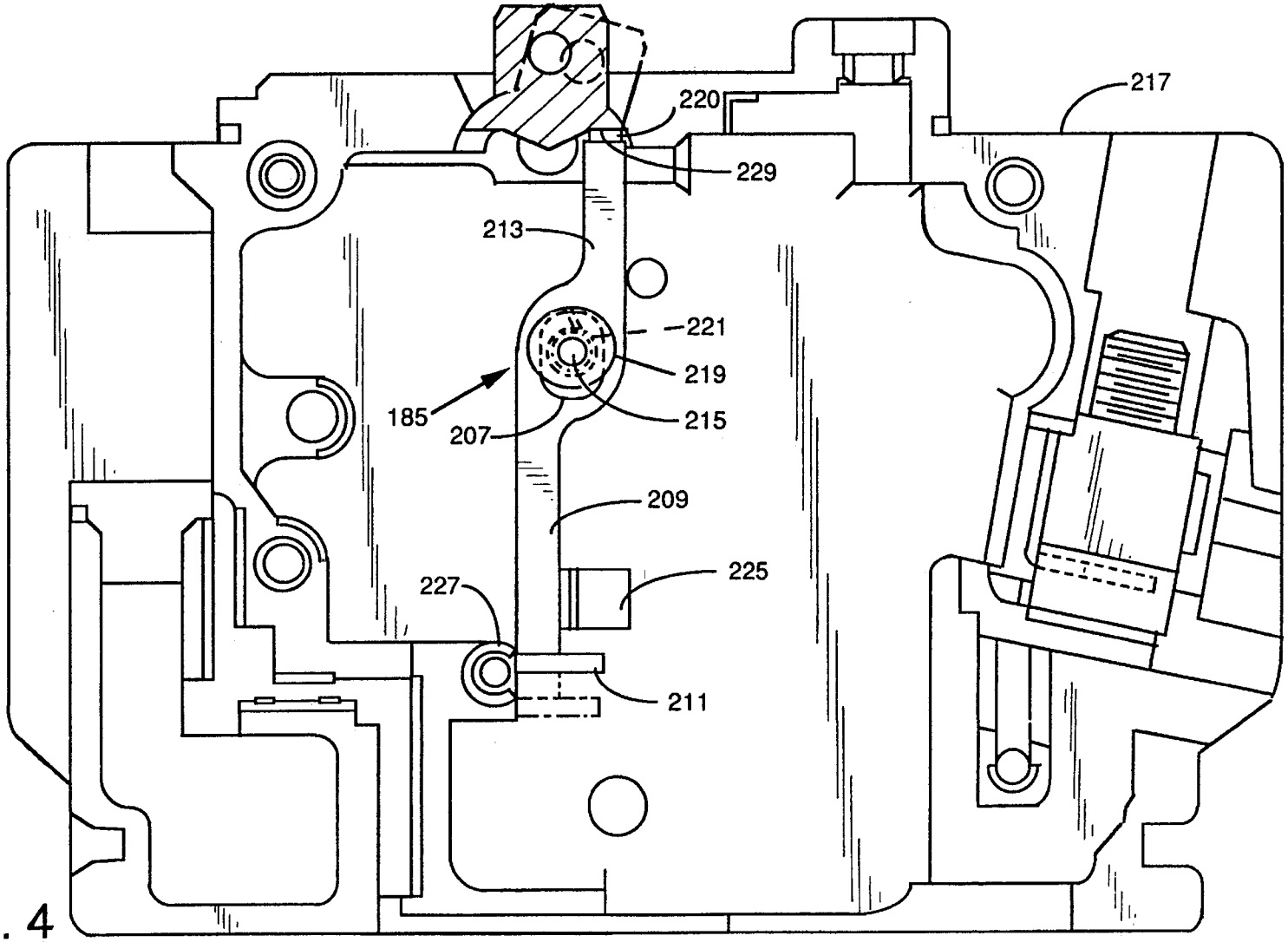
FIG. 4 is a vertical section essentially along the same line as FIG. 3, but looking in the opposite direction.

In operation, when the circuit breaker is turned on, the contacts 29 are closed, the cradle 49 is latched, and the handle 15 is in the on position (full counterclockwise in FIGS. 2 and 4). With the cradle 49 latched, the first actuating member 183 is pushed in the clockwise direction, as viewed in FIG. 5, by the plunger 179 on the micro switch 171. With the handle 15 in the on position, the second actuating member is biased upward by the torsion spring 221. When the circuit breaker is tripped, the cradle 49 is unlatched and is rotated clockwise as viewed in FIG. 2, and counterclockwise as viewed in FIG. 5 so that the lower edge 203 bears against the tab 199 of the first actuating member 183 thereby rotating the first actuating member counterclockwise as viewed in FIG. 5 so that the tab 195 on the first end depresses the plunger 179 on the micro switch 171. Actuation of the switch 171 provides an indication that the contacts 29 are open.

When the circuit breaker is turned off, the handle 15 is rotated to the right of vertical as viewed in FIG. 4 so that the cam surface 229 wedges against the tab 220 on projection 213 to force the second actuating member 185 downward against the bias of the torsion spring 221. This downward movement of the second actuating member 185 causes the tab 211 on the first end of the actuating member 185 to bear against the tab 195 on the first actuating member to depress the plunger 179 on the micro switch 171 to again provide an indication that the contacts 29 are open. Thus, although the circuit breaker 1 does not have a cross bar which provides a single indication of the position of the power contacts, the invention provides a simple compound mechanism for operating an auxiliary switch which can be accommodated in the limited space available within the circuit breaker.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A circuit breaker comprising:

a circuit breaker mechanism including:

a fixed contact;

a contact arm;

a movable contact secured to one end of said contact arm and movable by said contact arm toward and away from said fixed contact to close and open said contacts;

a pivotally mounted operating member engaging another end of said contact arm for moving, and for movement by, said contact arm between off/open and on/closed positions of said operating member and said contacts respectively, said operating member having an integral handle and a cam surface having a contour;

a pivotally mounted latchable cradle;

a spring connecting said latchable cradle and contact arm; and a trip device latching said cradle in a latched position and unlatching said cradle in response to preset current conditions, said cradle tripping said contact arm to open said contacts and move said operating member to a tripped position when unlatched;

an auxiliary switch having a plunger;

actuating means including a first actuating member engaging said cradle and actuating said auxiliary switch when said cradle is unlatched, and a second actuating member bearing against said cam surface on said operating member, said cam surface having a contour which actuates and said auxiliary switch through said second actuating member when said operating member, and said integral handle, are in the off position, said first and second actuating members being cascaded to operate said plunger; and a housing with first and second compartments separated by a partition, wherein said contacts, said contact arm, said spring, said cradle, and said trip device are mounted in said first compartment, and said auxiliary switch is mounted in said second compartment, wherein said operating member extends into both compartments with said cam surface located in said second compartment, said partition having an opening through which said first actuating member extends to engage said cradle and wherein said second actuating member is mounted in said second compartment to engage said camming surface and actuate said auxiliary switch.

2. The circuit breaker of claim 1 wherein said first actuating member has a first end engaging said plunger and a second end engaging said cradle, and wherein said second actuating member has a first end engaging the first end of said first actuating member to depress said plunger and a second end engaging said cam surface.

3. The circuit breaker of claim 2 including means mounting said first actuating member for pivotal motion and means mounting said second actuating member for rectilinear motion.

4. The circuit breaker of claim 3 including bias means biasing said second actuating member against said cam surface.

* * * * *